United States Patent [19]

Satō et al.

[11] 4,367,126

[45] Jan. 4, 1983

[54] PROCESS FOR PRODUCING ALKALI METAL HYDROXIDE

[75] Inventors: Kimihiko Satō; Yasuo Sajima; Junjiro Iwamoto; Makoto Nakao; Manabu Suhara; Makoto Noshiro, all of Yokohama, Japan

[73] Assignee: Asahi Glass Company, Ltd., Tokyo, Japan

[21] Appl. No.: 253,016

[22] Filed: Apr. 10, 1981

[30] Foreign Application Priority Data

Apr. 30, 1980 [JP] Japan ..... 55-56358

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 3,793,163 2/1974 Dotson ..... 204/98

4,065,366 12/1977 Oda et al. ..... 204/128

*Primary Examiner*—R. L. Andrews

*Attorney, Agent, or Firm*—Oblon, Fisher, Spivak, McClelland & Maier

[57] ABSTRACT

An alkali metal hydroxide is produced by electrolyzing an aqueous solution of an alkali metal chloride fed into an anode compartment in a cell having an anode compartment and a cathode compartment formed by partitioning with a cation exchange membrane. A cation exchange membrane of a fluorinated polymer having carboxylic acid groups at a content of 0.9 to 2.0 meq./g. dry resin is used as said cation exchange membrane and a metal or a metal ion is incorporated in said aqueous solution of an alkali metal chloride to form a thin layer made of a metal hydroxide or oxide on the surface of said membrane in the anode compartment.

7 Claims, No Drawings

PROCESS FOR PRODUCING ALKALI METAL HYDROXIDE

BACKGROUND OF THE INVENTION

1. Field of the Invention

The present invention relates to a process for producing an alkali metal hydroxide. More particularly, it relates to a process for producing an alkali metal hydroxide and chlorine by electrolyzing an aqueous solution of an alkali metal chloride at a low voltage by using a cation exchange membrane of a fluorinated polymer having carboxylic acid groups.

2. Description of the Prior Art

It has been proposed to use an ion exchange membrane in place of asbestos as a diaphragm to produce an alkali metal hydroxide by electrolyzing an aqueous solution of an alkali metal chloride so as to obtain an alkali metal hydroxide having high purity and high concentration.

In view of an alkali resistance and a chlorine resistance, a cation exchange membrane of a fluorinated polymer is preferably used as such ion exchange membrane and carboxylic acid groups are preferably selected as such cation exchange groups since an alkali metal hydroxide is produced at a high concentration in a high current efficiency.

On the other hand, recently energy saving has been considered in the world. In view of the energy saving, it is preferable to minimize a cell voltage for such technology.

Various manners for minimizing the cell voltage such as improvements of the materials, compositions and configurations of the anode and the cathode and selections of the composition of the cation exchange membrane and the kind of the ion exchange groups have been proposed. In accordance with such manner, certain effects have been found. However, the maximum concentrations of the resulting alkali metal hydroxide have not been so high in many cases. If the concentration of the alkali metal hydroxide is over the maximum level, it has not been satisfactory as an industrial process because of disadvantages of a severe increase of the cell voltage, a decrease of the current efficiency and the deterioration of membrane and durability of the cell voltage lowering phenomenon.

It has been proposed to incorporate a compound having an anion such as a phosphate which forms a water insoluble gel with a polyvalent cation such as calcium ion remained as the impurity in the anolyte as the solution of an electrolyte in a process for producing an alkali metal hydroxide by using an ion exchange membrane (U.S. Pat. No. 3,793,163). The polyvalent cation contained in an aqueous solution of an alkali metal chloride is penetrated into the ion exchange membrane to reduce a mobility of an alkali metal ion or to cause cracks in the membrane in an electrolysis by using a cation exchange membrane having sulfonic acid groups. The above-mentioned proposal is to prevent the penetration of the polyvalent cation into the cation exchange membrane whereby the characteristics of the membrane are maintained and the decrease of the current efficiency and the increase of the cell voltage are prevented.

In view of these considerations, cation exchange membranes of a fluorinated polymer having carboxylic acid groups as the ion exchange groups which are considered to give advantageous effects of high concentration of the resulting alkali metal hydroxide and current efficiency have been further studied. It has been found the following different phenomenon by using a cation exchange membrane of a fluorinated polymer having carboxylic acid groups at a specific content of the ion exchange groups instead of the cation exchange membrane having sulfonic acid groups. When a polyvalent cation preferably a specific cation which is considered to cause the trouble is incorporated or added without adding an anion such as phosphoric acid ion for forming the compound, the cell voltage can be reduced without any deterioration of the current efficiency as a surprising phenomenon.

SUMMARY OF THE INVENTION

It is an object of the present invention to provide a process for producing an alkali metal hydroxide by electrolyzing an aqueous solution of an alkali metal chloride at a low cell voltage in a high current efficiency.

The foregoing and other objects of the present invention have been attained by providing a process for producing an alkali metal hydroxide by electrolyzing an aqueous solution of an alkali metal chloride fed into an anode compartment in a cell having an anode compartment and a cathode compartment formed by partitioning with a cation exchange membrane, wherein a cation exchange membrane of a fluorinated polymer having carboxylic acid groups at a content of 0.9 to 2.0 meq./g. dry resin is used as said cation exchange membrane and a metal or a metal ion is incorporated in said aqueous solution of an alkali metal chloride to form a thin layer made of a metal hydroxide or oxide on the surface of said membrane in the anode compartment.

DETAILED DESCRIPTION OF THE PREFERRED EMBODIMENTS

The cation exchange membrane used for the process of the present invention can be made of a polymer having carboxylic acid groups as the cation exchange groups. Suitable polymers include copolymers of a vinyl monomer such as tetrafluoroethylene and chlorotrifluoroethylene and a perfluorovinyl monomer having carboxylic acid groups or functional groups which can be converted into carboxylic acid group.

It is especially preferable to use a polymer having the following units (A) and (B)

$$\left(CF_2\left(CXX'\right)\right) \quad \text{(A)}$$

$$\left(CF_2\left(\underset{\underset{Y-A}{|}}{CX}\right)\right) \quad \text{(B)}$$

wherein X represents fluorine, chlorine or hydrogen atom or $-CF_3$; X' represents X or $CF_3(CF_2)_m$; m represents an integer of 1 to 5; Y represents the following unit; $-(CF_2)_x$, $-O-(CF_2)_x$, $$\left(O-CF_2-\underset{\underset{Z}{|}}{CF}\right)_y,\ -CF_2\left(O-CF_2-\underset{\underset{Z}{|}}{CF}\right)_y,$$

$$\left(O-CF_2-\underset{\underset{Z}{|}}{CF}\right)_x\left(O-CF_2-\underset{\underset{Rf}{|}}{CF}\right)_y \text{ and}$$

-continued $$-O-CF_2\left(CF-O-CF_2\right)_x\left(CF_2\right)_y\left(CF_2-O-\underset{\underset{Rf}{|}}{CF}\right)_z$$

x, y and z respectively represent an integer of 1 to 10; Z and Rf represent —F or $C_1$–$C_{10}$ perfluoroalkyl group; and A represents —COOM or a functional group which is convertible into —COOM by a hydrolysis or a neutralization such as —CN, —COF, —$COOR_1$, —$CONR_2R_3$ and M represents hydrogen or an alkali metal atom; $R_1$ represents a $C_1$–$C_{10}$ alkyl group; $R_2$ and $R_3$ represent H or a $C_1$–$C_{10}$ alkyl group.

In the present invention, it is necessary to use a cation exchange membrane of a fluorinated polymer having carboxylic acid groups at a content ranging from 0.9 to 2.0 meq./g. dry polymer in the membrane. When the content of carboxylic acid groups is out of said range, the current efficiency is remarkably lower and the cell voltage reducing phenomenon in the present invention is not so effective or is unstable in the operation for a long time or is not maintained, so that it is not suitable to use such membrane.

When the cation exchange membrane having carboxylic acid groups at a content ranging from 1.0 to 1.7 meq./g. dry resin is used, the current efficiency reaches to more than 90% even though a concentration of sodium hydroxide is higher than 40%, and the electrolysis can be carried out in stable at a low cell voltage lower than that of the conventional electrolysis by about 0.1 to 0.4 Volt for a long period.

In order to give such ion-exchange capacity, a ratio of the units (b) in the copolymer of the units (a) and the units (b) is preferably in a range of 1 to 40 mole % especially 3 to 20 mole %.

The cation exchange membrane used for the present invention is preferably made of a non-crosslinked copolymer of a fluorinated olefin monomer and a monomer having carboxylic acid group or a functional group which can be converted into carboxylic acid group. A molecular weight of the copolymer is preferably in a range of about 100,000 to 2,000,000 especially 150,000 to 1,000,000.

In the preparation of such copolymer, one or more above-mentioned monomers can be used with a third monomer so as to improve the membrane. For example, a flexibility of the membrane can be imparted by incorporating $CF_2{=}CFORf$(Rf is a $C_1$–$C_{10}$ perfluoroalkyl group), or a mechanical strength of the membrane can be improved by crosslinking the copolymer with a divinyl monomer such as $CF_2{=}CF{-}CF{=}CF_2$ or $CF_2{=}CFO(CF_2)_{1\text{-}3}CF{=}CF_2$.

The copolymerization of the fluorinated olefin monomer and a monomer having carboxylic acid group or a functional group which is convertible into carboxylic acid group and another comonomer, can be carried out by a desired conventional process. The polymerization can be carried out if necessary, using a solvent such as halohydrocarbons by a catalytic polymerization, a thermal polymerization or a radiation-induced polymerization. A fabrication of the ion-exchange membrane from the resulting copolymer is not critical, for example, it can be known-methods such as a press-molding method, a roll-molding method, an extrusion-molding method, a solution spreading method, a dispersion molding method and a powder molding method.

The thickness of the membrane is preferably 20 to 1000 microns especially 50 to 400 microns.

When the functional groups of the fluorinated cation exchange membrane are groups which can be converted to carboxylic acid groups, the functional groups can be converted to carboxylic acid groups (COOM) by suitable treatment depending upon the functional groups before the membrane being used in electrolysis, preferably after the fabrication.

When the functional groups are —CN, —COF or —$COOR_1$ ($R_1$ are defined above), the functional groups can be converted to carboxylic acid groups by hydrolysis or neutralization with an acid or an alcoholic aqueous solution of a base.

The cation exchange membrane used in the present invention can be fabricated by blending a polyolefin such as polyethylene, polypropylene, preferably a fluorinated polymer such as polytetrafluoroethylene and a copolymer of ethylene and tetrafluoroethylene.

It is possible to use a cation exchange membrane having a dimensional stability which is obtained by reinforcing the membrane with a reinforcing substrate such as metallic wires or nets and synthetic resin nets.

The cation exchange membrane used in the present invention is not limited to be made of only one kind of the fluorinated polymer having carboxylic acid groups. It is possible to use a cation exchange membrane of two kinds of polymers wherein the ion exchange capacity in the cathode side is smaller than the ion exchange capacity in the anode side; or a cation exchange membrane which is made of the polymer having carboxylic acid groups in the cathode side and a polymer having sulfonic acid groups in the anode side. These cation exchange membranes are described in U.S. Pat. No. 4,151,053, No. 4,200,711 and No. 4,178,218.

A gas and liquid permeable porous layer containing particles having a function of a cathode or a gas and liquid permeable porous layer having non-function of a cathode can be bonded or contacted to the surface of the cation exchange membrane used in the present invention in the cathode side. The electrolysis of the invention is improved by using the membrane having said the porous layer. The former cation exchange membranes having a porous layer as the cathode are described in U.S. Pat. No. 4,224,121 and No. 4,191,618. The latter cation exchange membranes having a porous layer having non-function of a cathode are described in U.S. patent application Ser. No. 205,567.

An anode compartment and a cathode compartment are partitioned by the cation exchange membrane and an aqueous solution of an alkali metal chloride is fed into the anode compartment to carry out the electrolysis.

In accordance with the present invention, it is necessary to form a thin layer made of at least one of hydroxides and oxides of a metal selected from the group consisting of elements of IV-B group (preferably titanium, hafnium and zirconium) and iron group (preferably iron, nickel and cobalt) in the periodic table and aluminum, copper, ruthenium, niobium, beryllium, palladium, scandium and yttrium, on the surface of the cation exchange membrane in the anode side in the electrolysis.

An amount of the thin layer is different depending upon the kind of the metal or the metal ion used and is usually as a metal in a range of 0.005 to 50 mg. per 1 $cm^2$ of the cation exchange membrane.

When the amount of the thin layer on the membrane is less than the range, the stable electrolysis at a low cell voltage and the maintenance thereof are not satisfactory whereas, when it is more than the range, further advantageous effect can not be expected or the electric resistance is increased to be difficult to attain the object of the present invention.

When the amount of the thin layer as a metal is in a range of 0.01 to 20 mg./1 $cm^2$ of the cation exchange membrane, the stable electrolysis at a low cell voltage can be expected for a long period. This range is optimum. When a hydroxide of iron, nickel, cobalt, ruthenium, titanium, cerium, hafnium or zirconium is employed for the thin layer of the metal hydroxide the stable electrolysis at a low cell voltage can be especially expected for a long period.

In the process for forming the thin layer on the surface of the cation exchange membrane, the metal or the metal ion is incorporated in an aqueous solution of an alkali metal chloride as the electrolyte fed into the anode compartment whereby the metal or the metal ion is converted into the metal hydroxide in the high pH zone of the cation exchange membrane in the anode side to form the thin layer on the surface of the membrane. The metal hydroxide layer sometimes may be converted into the oxide in the oxidation atmosphere in the anolyte in the anode side. When the metal or the metal ion is present in a form of the impurity in the alkali metal chloride as iron component, it is possible to remain the impurity at a required concentration in the purification of the brine.

It is not necessary to feed continuously the metal or the metal ion for the thin layer during the electrolysis and it is possible to feed at the beginning of the electrolysis or intermittently the metal or the metal ion as far as the desired content is maintained.

The metal or the metal ion can be incorporated in a form of a metallic powder into the anolyte and can be also incorporated in a form of the compound soluble in the anolyte such as metal chloride, sulfate, hydroxide, nitrate or phosphate into the anolyte to form the metal ion.

In the formation of the thin layer, pH of the aqueous solution of an alkali metal chloride as the anolyte highly affects. pH is selected depending upon the kinds of the thin layer and the aqueous solution of an alkali metal chloride and is usually in a range of about 1 to 5. When pH is lower than the range, the thin layer of the metal hydroxide can not be effectively formed whereas when it is higher than the range, the bonding strength of the metal hydroxide as the thin layer on the surface of the membrane is disadvantageously not high enough and the cell voltage may be decreased.

When pH is in a range of 1 to 3, an effective thin layer is advantageously formed to be able to continue the stable electrolysis at a low cell voltage.

The anode used in the present invention is not critical and can be a conventional anode having dimensional stability which is prepared by coating an active component of a platinum group metal or an oxide thereof on a substrate made of a valve metal such as titanium and tantalum or the other conventional anode made of graphite etc.

The cathode can be made of iron, nickel, stainless steel, or Raney nickel etc. It is also possible to use the cathodes described in U.S. Pat. No. 4,170,536, No. 4,116,804, No. 4,190,514 and No. 4,190,516.

The aqueous solution of an alkali metal chloride used in the present invention is usually an aqueous solution of sodium chloride and can be other aqueous solution of an alkali metal chloride such as potassium chloride.

In the present invention, the process condition for the electrolysis of an aqueous solution of an alkali metal chloride can be a known condition in the prior arts.

For example, an aqueous solution of an alkali metal chloride (2.5 to 5.0 Normal) is fed into the anode compartment and water or a dilute solution of an alkali metal hydroxide is fed into the cathode compartment and the electrolysis is preferably carried out at 80° to 120° C. and at a current density of 10 to 100 A/$cm^2$.

The alkali metal hydroxide having a concentration of 20 to 50 wt.% is produced. In this case, the presence of heavy metal ion such as calcium or magnesium ion in the aqueous solution of an alkali metal chloride causes deterioration of the ion exchange membrane, and accordingly it is preferable to minimizes the content of the heavy metal ion. In order to prevent the generation of oxygen on the anode, it is preferable to feed an acid in the aqueous solution of an alkali metal chloride.

The present invention will be further illustrated by certain examples and references which are provided for purposes of illustration only and are not intended to limit the present invention.

EXAMPLE 1

An electrolytic cell having an effective electrolytic area of a width of 0.3 m and a height of 1.0 m was assembled by equipping with a metallic anode and a stainless cathode and a cation exchange membrane of a copolymer of $CF_2{=}CF_2$ and $CF_2{=}CFO(CF_2)_3COOCH_3$ which had a carboxylic acid group content of 1.45 meq./g. dry resin. The electrodes were set in a distance of 7 mm and a spacer net having an opening space of 85% and a thickness of 1.2 mm was set on the membrane in the cathode side.

A pure aqueous solution of sodium chloride was continuously fed into the anode compartment. The pure aqueous solution of sodium chloride was prepared by highly purifying a brine by passing through a chelate resin column to separate noxious heavy metal components such as calcium and magnesium. A deionized water was continuously fed into the cathode compartment and a current of 750 Amp was passed. After the initiation of the current supply, hydrochloric acid was fed to decrease temporarily pH to 1.2 in the anode compartment and metallic iron powder was fed at a ratio of 50 mg/liter into the anode compartment by a batch operation. In the anode compartment, pH was kept in 1.1 to 1.5 for 1 hour and then, the addition of hydrochloric acid was stopped.

The electrolysis was performed at a concentration of NaOH of 35% in the cathode compartment a concentration of NaCl of 200 g./liter in the anolyte and a temperature of the solution of 90° C. A cell voltage was 3.36 V, a current efficiency for producing NaOH was 95% and pH of the anolyte was 4.5 which were substantially kept in constant. After the operation for 108 days, the membrane was taken out and an iron component adhered on the membrane was analyzed to detect the iron component at a ratio of 0.058 mg./$cm^2$ of the membrane.

EXAMPLE 2

The electrolytic cell having the same structure of Example 1 was used under the condition that a current of 750 Amp was passed and hydrochloric acid was continuously fed into the aqueous solution of sodium chloride to control pH in the anode compartment in a range of 2.5 to 3.5 and a metallic iron powder was continuously fed at a ratio of 1 mg./liter after the initiation of the current supply. The operation was continued for 14 days and the supply of hydrochloric acid and the iron powder was stopped. The electrolysis was further performed at a concentration of NaOH of 35% in the cathode compartment and a concentration of NaCl of 204 g./liter in the anolyte and a temperature of the solution of 90° C. A cell voltage was 3.34 V. and a current efficiency for producing NaOH was 94.5% and pH of the anolyte was 4.5 which were substantially kept in constant. After the operation for 124 days, the membrane was taken out and iron component adhered on the surface of the membrane was analyzed to detect the iron component at a ratio of 0.135 mg./cm$^2$ of the membrane.

REFERENCE

The electrolytic cell having the structure of Example 1 was used under the condition that a current of 750 Amp was passed and the same aqueous solution of sodium chloride and the same water of Example 1 were used without feeding the feed of any iron component and the electrolysis was performed at a concentration of NaOH of 35% in the cathode compartment, a concentration of NaCl of 202 g./liter in the anolyte and a temperature of the solution of 90° C. A cell voltage was 3.63 V. and a current efficiency for producing sodium hydroxide was 94.5% and pH of the anolyte was 4.5 which were substantially kept in constant.

EXAMPLE 3

An electrolytic cell having the structure of Example 1 except using a cation exchange membrane of a copolymer of $CF_2{=}CF_2$ and $CF_2{=}CFO(CF_2)_3COOCH_3$ which had a carboxylic acid group content of 1.34 meq./g. dry resin, was used under the conditions that a concentration of KCl of 170 g./liter in the anolyte and a temperature of the solution of 90° C. and pH was kept in 3.5 by adding hydrochloric acid and a metallic zirconium powder was added by a batch system at a concentration of 20 mm./g. The electrolysis was performed by passing a current of 750 Amp to give a concentration of KOH of 35%. A cell voltage was 3.15 V. and a current efficiency for KOH was 97% which were kept in substantially constant. After the operation for 115 days, the membrane was taken out and zirconium component adhered on the surface of the membrane was analyzed to detect the zirconium component at a ratio of 0.030 mg./cm$^2$ of the membrane.

In accordance with the same process except adding the zirconium powder, the electrolysis was performed by passing a current of 750 Amp. A current efficiency for producing KOH was 97% to obtain 35% of KOH. A cell voltage was 3.40 V. which was substantially kept in constant.

EXAMPLE 4

In accordance with the process of Example 2 except that pH of an aqueous solution of NaCl was kept in 4.5 without adding hydrochloric acid and a metallic aluminum powder was continuously added at a ratio of 1 mg./liter, the electrolysis was performed. The operation was continued for 14 days and the supply of the aluminum powder was stopped. During the electrolysis, a cell voltage was 3.38 V. and a current efficiency for producing NaOH was 94.0%. After the operation for 115 days an aluminum component was detected at a ratio of 0.183 mg./cm$^2$ of the membrane.

EXAMPLE 5

In accordance with the process of Example 2 except that pH of an aqueous solution of NaCl was kept in 4.5 without adding hydrochloric acid and a copper powder was continuously added at a ratio of 1 mg./liter, the electrolysis was performed. The operation was continued for 14 days and the supply of the copper powder was stopped. During the electrolysis, a cell voltage was 3.37 V. and a current efficiency for producing NaOH was 94.5%. After the operation for 109 days, a copper component was detected at a ratio of 0.245 mg./cm$^2$ of the membrane.

EXAMPLE 6

An electrolytic cell having an effective electrolytic area of a width of 16 cm and a height of 30 cm was assembled by equipping with a metallic anode and a stainless cathode and a cation exchange membrane of a copolymer of $CF_2{=}CF_2$ and $CF_2{=}CFO(CF_2)_3COOCH_3$ which had a carboxylic acid group content of 1.45 meq./g. dry resin. The electrodes and the membrane were set in a distance of 3 mm without a spacer net.

A pure aqueous solution of sodium chloride purified by the process of Example 1 was continuously fed into the anode compartment to give a concentration of NaCl in the anolyte of 190–215 g/l. A deionized water was continuously fed into the cathode compartment to give a concentration of NaOH of 35% and a current of 120 Amp was passed at 90° C. Three days after the initiation of the current supply, a solution of hydrochloric acid dissolving each metal hydroxide was continuously fed for 24 hours to give each concentration of the metal component and each pH shown in Table and then, the addition of hydrochloric acid was stopped and the electrolysis was contained for 30 to 50 days. At each days after the initiation, shown in Table, the data for electrolysis were measured. The results are shown in Table.

TABLE

| Condition for addition of metal hydroxide | | | Data for electrolysis | | |
|---|---|---|---|---|---|
| Kind of additive | Concentration in anolyte (mg/l) | Anolyte (pH) | Days | Cell voltage (V) | Current efficiency (%) |
| none | 0 | 4.5 | 48 | 3.40 | 94.2 |
| $Ti(OH)_4$ | 2 | 1.2 | 38 | 3.29 | 94.5 |
| $Hf(OH)_4$ | 2 | 2.0 | 50 | 3.25 | 93.8 |
| $Nb(OH)_5$ | 2 | 1.2 | 38 | 3.30 | 94.8 |
| $Ru(OH)_3$ | 2 | 2.0 | 50 | 3.27 | 94.3 |
| $Be(OH)_2$ | 2 | 4.5 | 30 | 3.30 | 93.8 |
| $Pd(OH)_2$ | 2 | 1.2 | 38 | 3.28 | 95.1 |
| $Sc(OH)_3$ | 2 | 4.5 | 30 | 3.30 | 93.5 |
| $Y(OH)_3$ | 2 | 4.5 | 30 | 3.32 | 94.2 |

EXAMPLE 7

A membrane of a copolymer of $CF_2{=}CF_2$ and $CF_2{=}CFOCF_2CF(CF_3)OCF_2CF_2SO_2F$ (an ion exchange capacity of 0.83 meq./g. dry resin) which was reinforced by 70 mesh polytetrafluoroethylene woven fabric (total thickness of 125$\mu$) was superposed to a membrane of a copolymer of $CF_2{=}CF_2$ and $CF_2{=}CFO(CF_2)_3COOCH_3$ (an ion exchange capacity of 1.0 meq./g. dry resin) (30$\mu$) and they were heat-pressed at 240° C. under 0.8 kg./cm$^2$ for 5 minutes to laminate them. The laminated membrane was hydrolyzed in an aqueous solution of sodium hydroxide to prepare a cation exchange membrane.

An electrolysis of an aqueous solution of sodium chloride was carried out under the following condition.

An electrolytic cell having an effective electrolytic area of 25 $cm^2$ were assembled by using an anode made by titanium expanded metal coated with ruthenium oxide; a cathode made by stainless expanded metal and the resulting cation exchange membrane. (The carboxylic acid type membrane faces to the cathode).

Condition of electrolysis:

| | |
|---|---|
| Current density: | 30 $A/dm^2$ |
| Electrolysis temperature: | 90° C. |
| Anolyte: | 3.5N—NaCl aq. solution |
| Catholyte: | 22% NaOH aq. solution |

In the anode compartment, 5 N-NaCl aqueous solution containing HCl and $FeCl_3$ at a concentration of Fe of 2 mg./liter and pH of 2–3 was fed. In the cathode compartment, water was fed to maintain 22% NaOH.

The results of the electrolysis 10 days after the initiation are as follows.

| | |
|---|---|
| Cell voltage (V): | 3.42 |
| Current efficiency (%): | 94.0 |

EXAMPLE 8

In 50 ml. of water, 73 mg. of ruthenium black having a particle diameter of 44μ was suspended and a suspension of polytetrafluoroethyl (PTFE) (Teflon 30J manufactured by Du Pont) was added to give 7.3 mg. of PTFE. One drop of nonionic surfactant (Triton X-100 manufactured by Rhom & Haas) was added to the mixture. The mixture was stirred by ultrasonic vibration under cooling with ice and was filtered on a porous PTFE sheet to obtain a thin porous layer of stabilized Raney nickel. The thin porous layer had a thickness of 30μ, a porosity of 75% and a content of stabilized Raney nickel of 5 mg./$cm^2$.

The thin porous layer was superposed on a cation exchange membrane made of a copolymer of $CF_2{=}CF_2$ and $CF_2{=}CFO(CF_2)_3COOCH_3$ having an ion exchange capacity of 1.45 meq./g. dry resin and a thickness of 250μ to position the PTFE sheet in the outside of the cation exchange membrane and they were pressed at 160° C. under a pressure of 60 kg./$cm^2$ to bond the stabilized Raney nickel thin layer on the cation exchange membrane. Then, the PTFE sheet was peeled off to obtain the cation exchange membrane on the surface of which the porous layer of the stabilized Raney nickel was bonded.

The cation exchange membrane was hydrolyzed by dipping it in 25 wt. % aqueous solution of sodium hydroxide at 90° C. for 16 hours.

A nickel gauze (20 mesh) was brought into contact with the stabilized Raney nickel layer on the cation exchange membrane and a platinum gauze (40 mesh) was brought into contact with the opposite surface under a pressure, and an electrolytic cell was assembled by using the cation exchange membrane laminated product and the platinum gauze as an anode and the nickel gauze as a cathode.

Ferric chloride was dissolved in 5 N-NaCl aqueous solution at a ratio of 2 mg./liter in the anode compartment of the electrolytic cell to give a concentration of the aqueous solution of NaCl at 4 normal and pH of 2 in the anode compartment and water was fed into the cathode compartment and an electrolysis was performed at 90° C. to maintain a concentration of sodium hydroxide of 35 wt. %. The results are as follows.

| Current density ($A/dm^2$) | Cell voltage (V) |
|---|---|
| 20 | 2.81 |
| 40 | 3.09 |

The electrolysis was performed for 200 days at a current density of 20 $A/dm^2$, the cell voltage was 2.82 V. which was substantially the same. The current efficiency for producing sodium hydroxide was 93% which was constant.

REFERENCE 2

In accordance with the process of Example 8 except that an aqueous solution of NaCl which did not incorporate any iron component was fed, the electrolysis was performed. The results are as follows.

| Current density ($A/dm^2$) | Cell voltage (V) |
|---|---|
| 20 | 3.00 |
| 40 | 3.48 |

EXAMPLE 9

In accordance with the process of Example 8 except that zirconium chloride was dissolved in 5 N-NaCl aqueous solution at a ratio of 2 mg./liter of a zirconium component and the solution was kept in pH of 4 and fed into the anode compartment, the electrolysis was performed. The results are as follows.

| Current density ($A/dm^2$) | Cell voltage (V) |
|---|---|
| 20 | 2.86 |
| 40 | 3.20 |

The electrolysis was performed for 220 days at a current density of 20 $A/dm^2$, the cell voltage was 2.87 V. which was substantially the same. The current efficiency for producing sodium hydroxide was 94% which was constant.

EXAMPLE 10

In 50 ml. of water, 73 mg. of titanium oxide powder having a particle diameter of 44μ was suspended and a suspension of polytetrafluoroethylene (PTFE) (Teflon 30J manufactured by Du Pont) was added to give 7.3 mg. of PTFE. One drop of nonionic surfactant (Triton X-100 manufactured by Rhom & Haas) was added to the mixture. The mixture was stirred by ultrasonic vibration under cooling with ice and was filtered on a porous PTFE sheet to obtain a thin porous layer. The thin porous layer had a thickness of 31μ, a porosity of 75% and a content of titanium oxide of 5 mg./$cm^2$.

The thin porous layer was superposed on a cation exchange membrane made of a copolymer of $CF_2{=}CF_2$ and $CF_2{=}CFO(CF_2)_3COOCH_3$ having an ion exchange capacity of 1.45 meq./g. dry resin and a thickness of 250μ to position the PTFE sheet in the outside of the cation exchange membrane and they were pressed at 160° C. under a pressure of 60 kg./cm$^2$ to bond the titanium oxide thin layer on the cation exchange membrane. Then, the PTFE sheet was peeled off to obtain the cation exchange membrane on the surface of which the porous layer of titanium oxide was bonded.

The cation exchange membrane was hydrolyzed by dipping it in 25 wt. % of aqueous solution of sodium hydroxide at 90° C. for 16 hours.

A nickel expanded metal having a major diameter of 5 mm and a minor diameter of 2.5 mm was brought into contact with the titanium oxide layer on the cation exchange membrane and a titanium expanded metal having a major diameter of 5 mm and a minor diameter of 2.5 mm and having a coated layer made of ruthenium oxide, iridium oxide and titanium oxide at 3:1:4 was brought into contact with the opposite surface under a pressure, and an electrolytic cell was assembled by using the cation exchange membrane laminated product and the titanium expanded metal as an anode and the nickel expanded metal as a cathode.

Ferric chloride was dissolved in 5 N-NaCl aqueous solution at a ratio of 2 mg./liter in the anode compartment of the electrolytic cell to give a concentration of the aqueous solution of NaCl at 4 normal and pH of 2 in the anode compartment and water was fed into the cathode compartment and an electrolysis was performed at 90° C. to maintain a concentration of sodium hydroxide of 35 wt. %. The results are as follows.

| Current density (A/dm$^2$) | Cell voltage (V) |
|---|---|
| 20 | 3.02 |
| 40 | 3.41 |

The electrolysis was performed for 30 days at a current density of 20 A/dm$^2$, the cell voltage was 3.03 V. which was the substantially the same.

The current efficiency for producing sodium hydroxide was 93% which was constant.

REFERENCE 3

In accordance with the process of Example 10 except that an aqueous solution of NaCl which did not incorporate any iron component was fed, the electrolysis was performed. The results are as follows.

| Current density (A/dm$^2$) | Cell voltage (V) |
|---|---|
| 20 | 3.23 |
| 40 | 3.69 |

EXAMPLE 11

In accordance with the process of Example 10 except that zirconium chloride was dissolved in 5 N-NaCl aqueous solution at a ratio of 2 mg./liter of a zirconium component and the solution was kept in pH of 4 and fed into the anode component, the electrolysis was performed. The results are as follows.

| Current density (A/dm$^2$) | Cell voltage (V) |
|---|---|
| 20 | 3.05 |

-continued

| Current density (A/dm$^2$) | Cell voltage (V) |
|---|---|
| 40 | 3.43 |

The electrolysis was performed for 30 days at a current density of 20 A/dm$^2$, the cell voltage was 3.06 V. which was substantially the same. The current efficiency for producing sodium hydroxide was 94% which was constant.

We claim:

1. In a process for producing an alkali metal hydroxide by electrolyzing an aqueous solution of an alkali metal chloride fed into an anode compartment in a cell having an anode compartment and a cathode compartment formed by partitioning with a cation exchange membrane, an improvement characterized in that a cation exchange membrane of a fluorinated polymer having carboxylic acid groups at a content of 0.9 to 2.0 meq./g/dry resin is used as said cation exchange membrane and a metal or a metal ion is incorporated in said aqueous solution of an alkali metal chloride to form a thin layer made of a metal hydroxide or oxide on the surface of said membrane in the anode compartment, wherein said metal for the metal or metal ion is selected from the group consisting of elements of IV-B group and iron group of the periodic table, and aluminum, copper, ruthenium, cerium, niobium, beryllium, palladium, scandium and yttrium.

2. The process according to claim 1 wherein said metal or metal ion is selected from the group consisting of metallic powder, metal chlorides, hydroxide, phosphates, nitrates and sulfates.

3. The process according to claim 1 wherein said thin layer made of a metal hydroxide or oxide formed on the surface of said membrane has a metal component ranging from 0.005 to 50 mg. per 1 cm$^2$ of the surface of said membrane.

4. The process according to claim 1 or 4 wherein pH of said aqueous solution of an alkali metal chloride in said anode compartment is in a range of 1 to 5.

5. The process according to claim 1 wherein said cation exchange membrane comprises the following fluorinated polymer having carboxylic acid groups having units (A) and (B) at least in a layer in said cathode side $$\left(CF_2-\underset{}{C}XX'\right) \quad \text{(A)}$$

$$\left(CF_2-\underset{\underset{Y-A}{|}}{C}X\right) \quad \text{(B)}$$

wherein X represents fluorine, chlorine or hydrogen atom or $-CF_3$; X' represents X or $CF_3(CF_2)_m$; m represents an integer of 1 to 5; Y represents the following unit; $(CF_2)_x$, $-O(CF_2)_x$, $$\left(O-CF_2-\underset{\underset{Z}{|}}{C}F\right)_y,\ -CF_2\left(O-CF_2-\underset{\underset{Z}{|}}{C}F\right)_y,$$

$$\left(O-CF_2-\underset{\underset{Z}{|}}{C}F\right)_x\left(O-CF_2-\underset{\underset{Rf}{|}}{C}F\right)_y \text{ and}$$

-continued $$-O-CF_2\left(CF-O-CF_2\right)_x\left(CF_2\right)_y\left(CF_2-O-\underset{\underset{Rf}{|}}{CF}\right)_z$$

x, y and z respectively represent an integer of 1 to 10; Z and Rf represent —F or $C_1$-$C_{10}$ perfluoroalkyl group; and A represents —COOM or a functional group which is convertible into —COOM by a hydrolysis or a neutralization such as —CN, —COF, —$COOR_1$, —$CONR_2R_3$ and M represents hydrogen or an alkyl metal atom; $R_1$ represents a $C_1$-$C_{10}$ alkyl group; $R_2$ and $R_3$ represent H or a $C_1$-$C_{10}$ alkyl group.

6. The process according to claim 5 wherein a layer of said cation exchange membrane in a anode side comprises a polymer having sulfonic acid groups.

7. The process according to claim 5 or 6 wherein a thickness of said cation exchange membrane is in a range of 20 to 1,000$\mu$.

* * * * *